US006239754B1

(12) United States Patent
Kim

(10) Patent No.: US 6,239,754 B1
(45) Date of Patent: May 29, 2001

(54) AUTOMATIC RETRACTABLE ANTENNA SYSTEM IN PORTABLE PHONE

(75) Inventor: Ki-Hyun Kim, Suwon-shi (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/340,820

(22) Filed: Jun. 28, 1999

(30) Foreign Application Priority Data

Jun. 26, 1998 (KR) ..... 98-24444

(51) Int. Cl.[7] ..... H01Q 1/24
(52) U.S. Cl. ..... 343/702; 343/766; 343/901
(58) Field of Search ..... 343/702, 766, 343/901, 883

(56) References Cited

U.S. PATENT DOCUMENTS 2,211,858 * 8/1940 Martin ..... 343/901
4,803,493 * 2/1989 Jamison ..... 343/745
5,315,795 * 5/1994 Chae et al. ..... 343/874
5,414,436 * 5/1995 Shindawa et al. ..... 343/715
5,541,615 * 7/1996 Koide et al. ..... 343/858

* cited by examiner

*Primary Examiner*—Don Wong
*Assistant Examiner*—Shih-Chao Chen
(74) *Attorney, Agent, or Firm*—Dilworth & Barrese, LLP

(57) ABSTRACT

A mechanism for extending and retracting an antenna in a portable phone. A driving motor is provided and has a motor shaft around which a worm is fit, a worm gear is engaged with the worm of the motor shaft, and a pulley arrangement is provided which includes a roller shaft which connects the worm gear to a first pulley roller, a timing belt that transfers the force of the first pulley roller to a second pulley roller. A driving roller and a driven roller receive the force from the second pulley roller, and an antenna rod is disposed between the driving and driven rollers, to be extended/retracted by the driving and driven rollers. A first main bracket is provided which has a space for holding the driving motor, a first free end for supporting the worm gear, and a second free end for supporting the driving roller. A second main bracket is also provided which has an engaging end to be engaged with the first main bracket and a guide rib for supporting the driving motor, and a sub-bracket is connected to the second main bracket for supporting the driven roller downward.

15 Claims, 9 Drawing Sheets

AUTOMATIC RETRACTABLE ANTENNA SYSTEM IN PORTABLE PHONE

This application makes reference to, incorporates the same herein, and claims all benefits accruing under 35 U.S.C. §119 from an application entitled AUTOMATIC RETRACTABLE ANTENNA SYSTEM IN PORTABLE PHONE earlier filed in the Korean Industrial Property Office on Jun. 26, 1998, and there duly assigned Ser. No. 98-24444.

BACKGROUND OF THE INVENTION

1. Field of the Invention

The present invention relates to an automatic retractable antenna system, and more particularly, to a system for extending an automatic retractable antenna for combatting disturbances to the extending/retracting of a rod antenna.

2. Description of the Related Art

FIGS. 1 and 2 are perspective views of a conventional portable phone in an on-hook state and an off-hook state, respectively. The portable phone is a flip type.

The off-hook state refers to a speech mode state, and the on-hook state refers to a speech standby state. Referring to FIGS. 1 and 2, this portable phone includes a body 1000, a flip cover 2000, and a hinge (not shown) for mechanically connecting the body 1000 to the flip cover 2000.

The body 1000 has an upper casing frame 1010 and a lower casing frame 1020. An antenna device 1001 is installed on an upper end of the body 1000, and an ear piece 1002 is located on an upper portion of the upper casing frame 1010. Under the earpiece 1002 are disposed an LCD (Liquid Crystal Display) window 1003, a key pad 1004 including a plurality of keys, and a microphone 1005. The hinge is located at a lower portion 1006 which includes microphone 1005.

In accordance with the conventional portable phone, when the flip cover 2000 is opened, a speech mode is automatically set and a rod antenna 1001*b* is automatically extended. Conversely, when the flip cover 2000 is closed, a speech standby mode is automatically set and the rod antenna 1001*b* is automatically retracted.

FIG. 3 is a plan view of an automatic retractable antenna system inserted in an antenna housing 1001 a in the conventional portable phone. The conventional automatic retractable antenna system is installed in the lower casing frame 1020 by a fixing means including a fixing pin 452 and a bracket 420. Here, an elastic member 454, preferably constructed of rubber, is added to the fixing means to absorb vibrations generated when a motor 410 is driven. The rod antenna 1001*b* is moved by driving the motor 410 to rotate a pair of roller assemblies 430 and 440.

FIG. 4 is a perspective view of the conventional automatic retractable antenna system. The conventional automatic retractable antenna system includes motor 410, typically a small coreless type DC (Direct Current) motor, the pair of rollers 430 and 440 rotated by the motor 410, and the bracket 420 for fixing the rollers 430 and 440 to the motor 410. The motor 410 includes a motor shaft 411 which rotates clockwise or counterclockwise depending on the polarity of a power supply voltage received from a microprocessor. The outer circumferential surface of the motor shaft 411 is typically coated with rubber to maximize frictional and elastic forces.

The bracket 420 has a base 421 to be fixed to the motor 410 with respect to a rotating axis A1. A hole 422 is formed at the center of the base 421, for inserting the motor shaft 411 therein, and an engaging end 423 is bent downward from the outer circumferential surface of the base 421 and soldered to the motor 410. Thus, the bracket 420 is fixed to the motor 410. The bracket 420 also includes free ends 424 and 425 bent at a right angle to fix the roller assemblies 430 and 440. The free ends 424 and 425 have coaxial holes for inserting roller shafts 431*a* and 441*a* therein.

The roller assembly 430 has a disc shaped member 431 for contacting with the motor shaft 411 and roller 432 for contacting with the antenna system. Similarly, the roller assembly 440 has a disc shaped member 441 for contacting with the disc shaped member 431 of roller assembly 430 and a roller 442 for contacting with the antenna system. Similarly, the diameter of the rollers 432 and 442 is smaller than that of the disc shaped members 431 and 441. Thus, the motor shaft 411 rotates with respect to the axis A1, the roller assembly 430 with respect to an axis A2, and then the roller assembly 440 with respect to an axis A3 to effect a force transfer.

FIG. 5 is a plan view for describing the operation of the conventional automatic retractable antenna system. Referring to FIGS. 4 and 5, when the motor 410 is driven, the roller assembly 430 rotates in contact with the motor shaft 411 and the roller assembly 440 rotates in contact with the roller assembly 430. Then, the frictional force between the rod antenna 1001*b* and the outer circumferential surfaces of the rollers 432and 442 extends/retracts the rod antenna 1001*b*. The frictional force, since it is generated from the tight contact between the rollers 432 and 442, experiences little transfer loss.

When the motor shaft 411 rotates clockwise, the roller assembly 430 rotates counterclockwise in contact with the motor shaft 411, and the roller assembly 440 rotates clockwise in contact with the roller assembly 430.

Though the rollers 432 and 442 are formed of an elastic material such as rubber, they show limitations in their effectiveness of maximizing the frictional force with the rod antenna during extending/retracting the rod antenna. Especially, a slip phenomenon is frequently observed during the extending. and retracting operations. Furthermore, the extension/retraction of the rod antenna is not reliable because rod antennas typically do not have a constant diameter along its length. If a user inadvertently imposes an external impact on the rod antenna while extending it, the rod antenna is warped or malfunctions, deteriorating the antenna characteristics.

In view of the characteristics of a portable phone, it should be highly resistant against dropping or other impacts, and the rod antenna should be stably moved during extending/retracting. In addition, there is a need for extending/retracting the rod antenna by driving a motor with low power consumption and minimized frictional force.

SUMMARY OF THE INVENTION

An object of the present invention is to provide an automatic system for extending and retracting an antenna in a portable phone, which can accommodate the varying diameter of a rod antenna along its length.

Another object of the present invention is to provide an automatic system for extending and retracting an antenna system in a portable phone that will accommodate a disturbance to the extending or retracting system for the antenna without incurring damage to the system.

Another object of the present invention is to provide an automatic retractable antenna system in a portable phone, which can cope with vibrations generated when a motor is driven.

A further object of the present invention is to provide an automatic retractable antenna system in a portable phone, in which a worm and a worm gear are used.

Still another object of the present invention is to provide an automatic retractable antenna system in a portable phone, in which a rod antenna can be operated automatically or manually.

To achieve the above objects, there is provided an automatic system for extending and retracting an antenna in a portable phone. A driving motor has a motor shaft with a worm, a worm gear is engaged with the motor shaft; a pulley arrangement including a first roller or wheel spaced from and attached by a shaft to the worm gear, a timing belt which transfers the force of the first roller or wheel a second roller or wheel; the second roller or wheel has means to turn a driving roller when it receives the force from the timing belt. The driving roller and a driven roller receive the force from the second roller or wheel, a rod antenna is disposed between the driving and driven rollers, to be extended/retracted by the driving and driven rollers. A first main bracket is provided and has a space for holding the driving motor, a first free end for supporting the worm gear, and a second free end for supporting the driving roller, while a second main bracket has an engaging end to be engaged with the first main bracket and a guide rib for supporting the driving motor. A sub-bracket is connected to the second main bracket, for compressing the driven roller downward.

BRIEF DESCRIPTION OF THE DRAWINGS

To The above objects and advantages of the present invention will become more apparent by describing in detail a preferred embodiment thereof with reference to the attached drawings in which.

DETAILED DESCRIPTION OF THE PREFERRED EMBODIMENT

Figure 1:
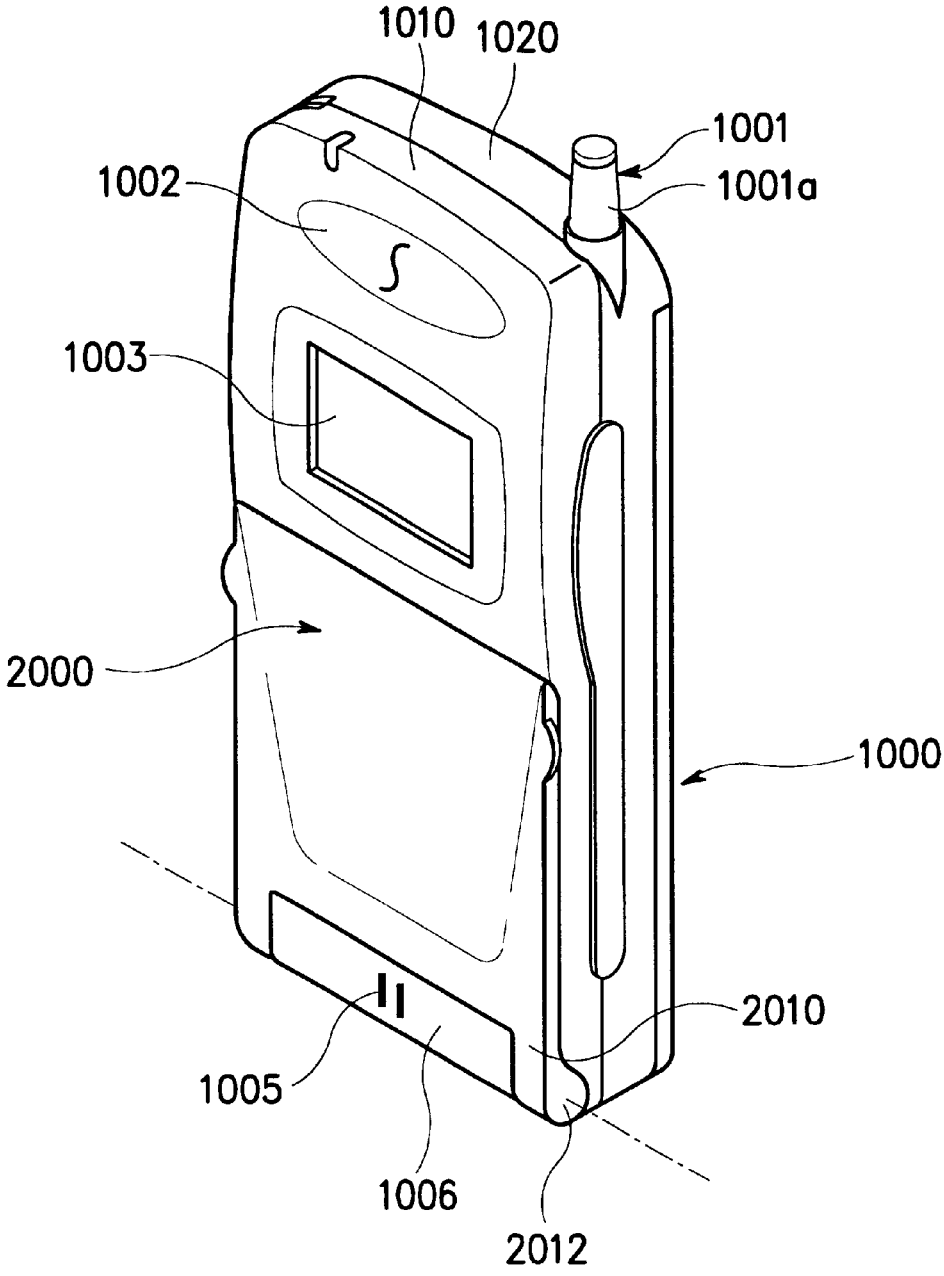
FIG. 1 PRIOR ART
FIG. 1 is a perspective view of a conventional portable phone in an on-hook state.
Figure 2:
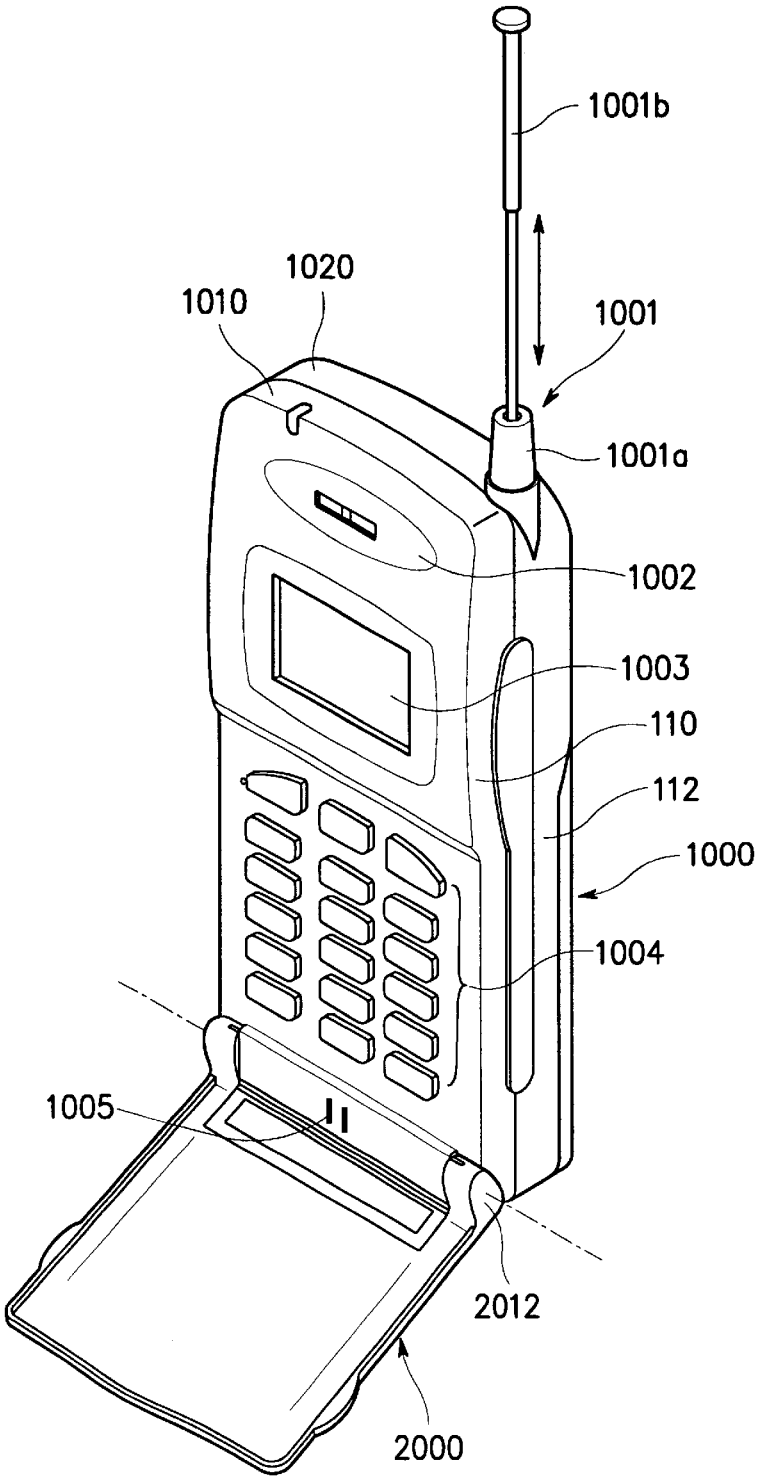
FIG. 2 PRIOR ART
FIG. 2 is a perspective view of the conventional portable phone in an off-hook state.
Figure 3:
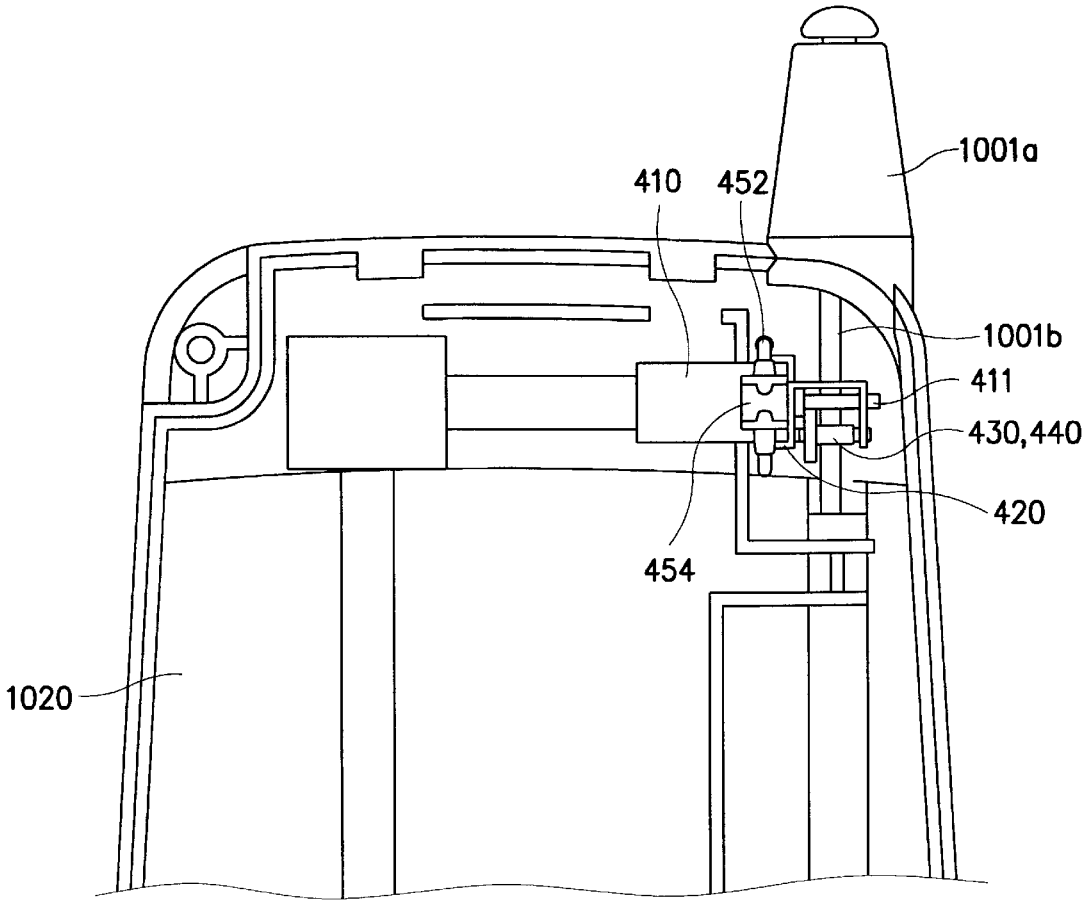
PRIOR ART FIG. 3
FIG. 3 is a plan view of a conventional automatic retractable antenna system installed in an antenna housing.
Figure 4:
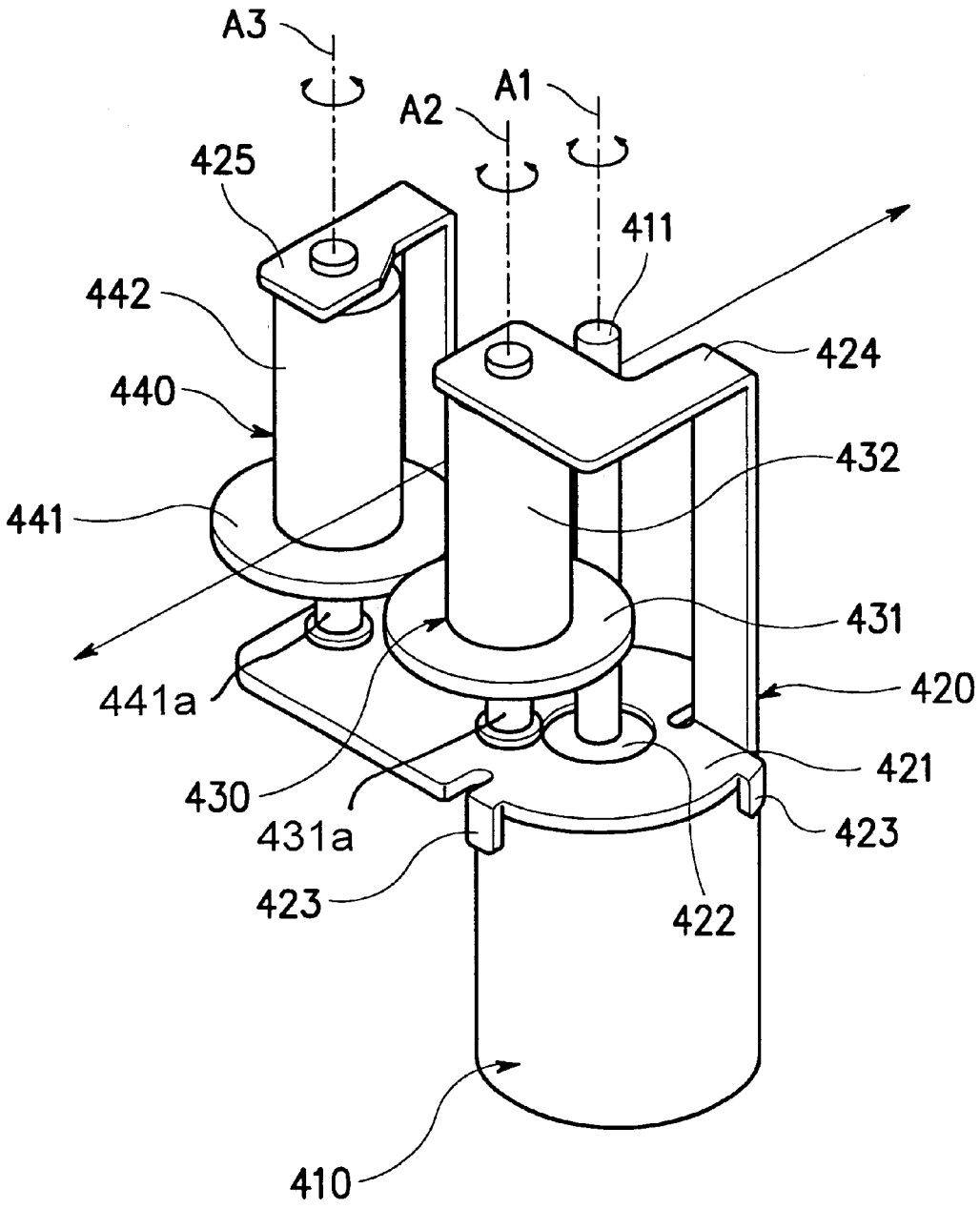
PRIOR ART FIG. 4
FIG. 4 is a perspective view of the conventional automatic retractable antenna system.
Figure 5:
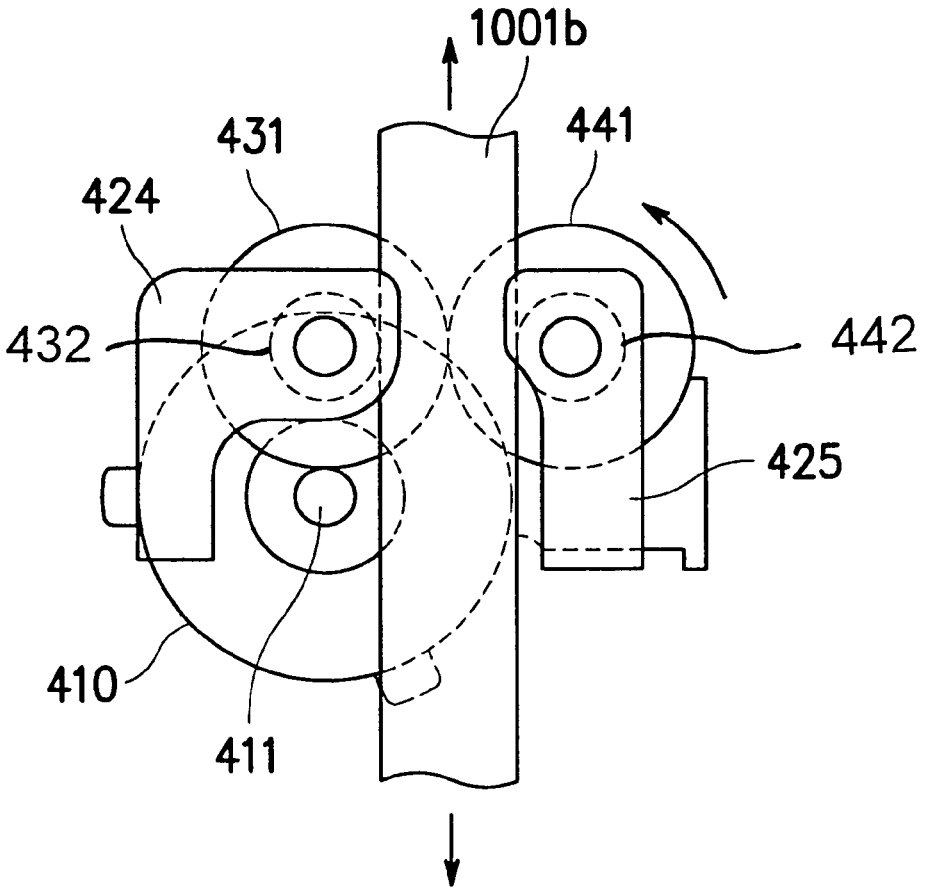
PRIOR ART FIG. 5
FIG. 5 is a plan view of the conventional automatic retractable antenna system.
Figure 6:
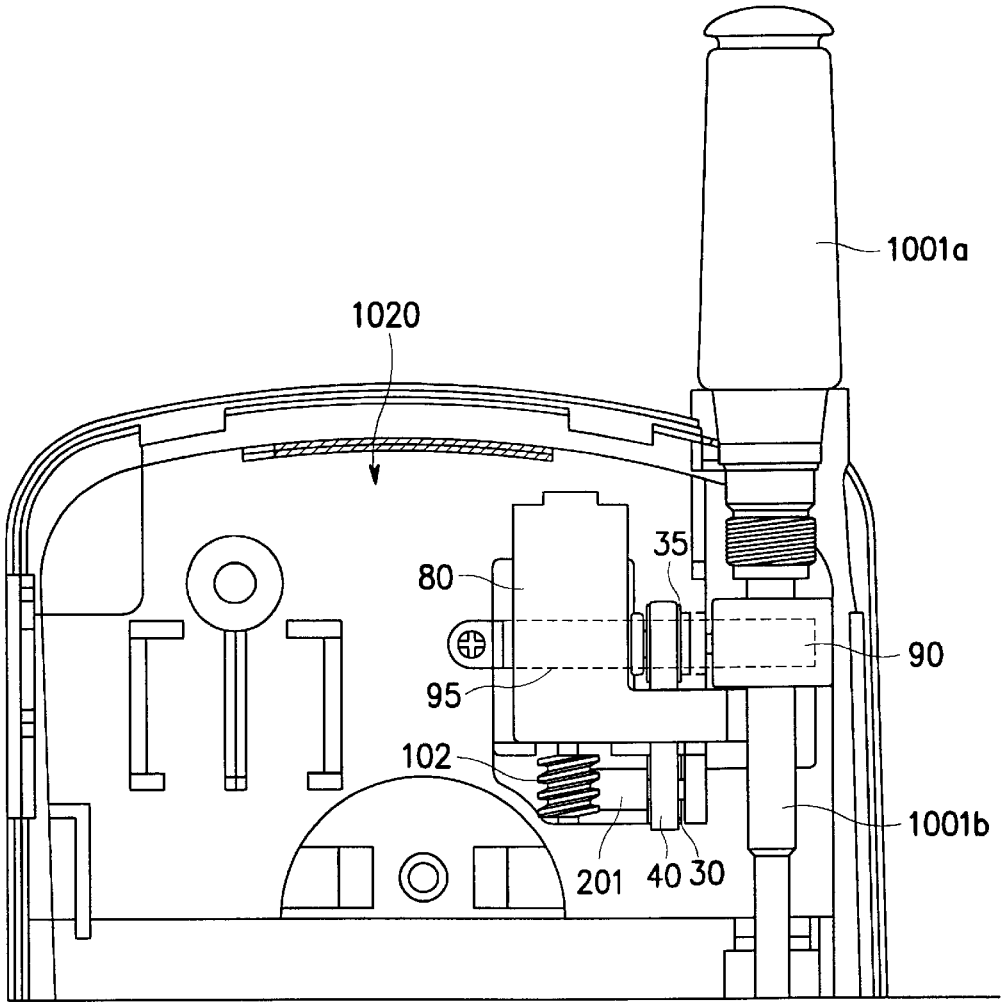
FIG. 6 is a plan view of an automatic retractable antenna system installed in a lower casing frame according to a preferred embodiment of the present invention.
Figure 7:
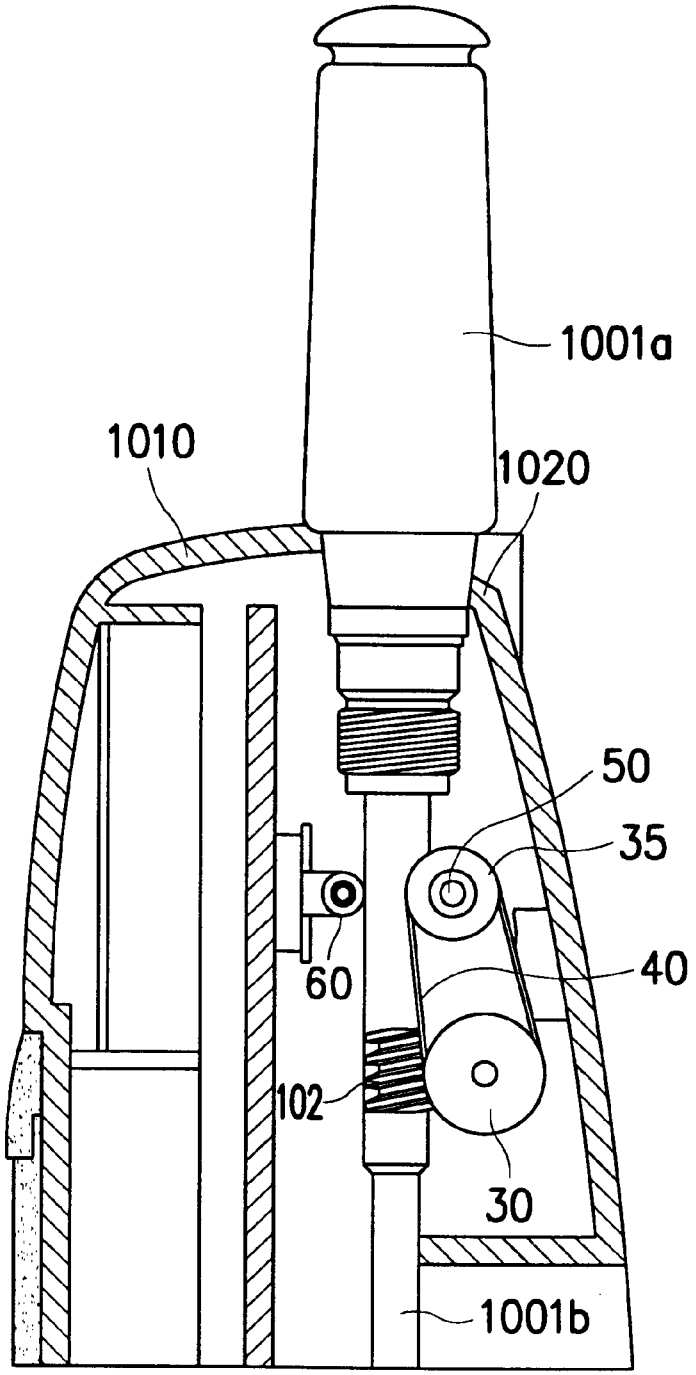
FIG. 7 is a schematic side view of the automatic retractable antenna system installed in the lower casing frame according to the preferred embodiment of the present invention.

FIGS. 6 and 7 are respectively plan and side views of an automatic retractable antenna system installed in a lower casing frame according to a preferred embodiment of the present invention. The automatic retractable antenna system employs a mechanism for automatically extending a rod antenna from a portable telephone body upon a call termination and retracting the rod antenna into the body upon completion of the call.

Figure 8:
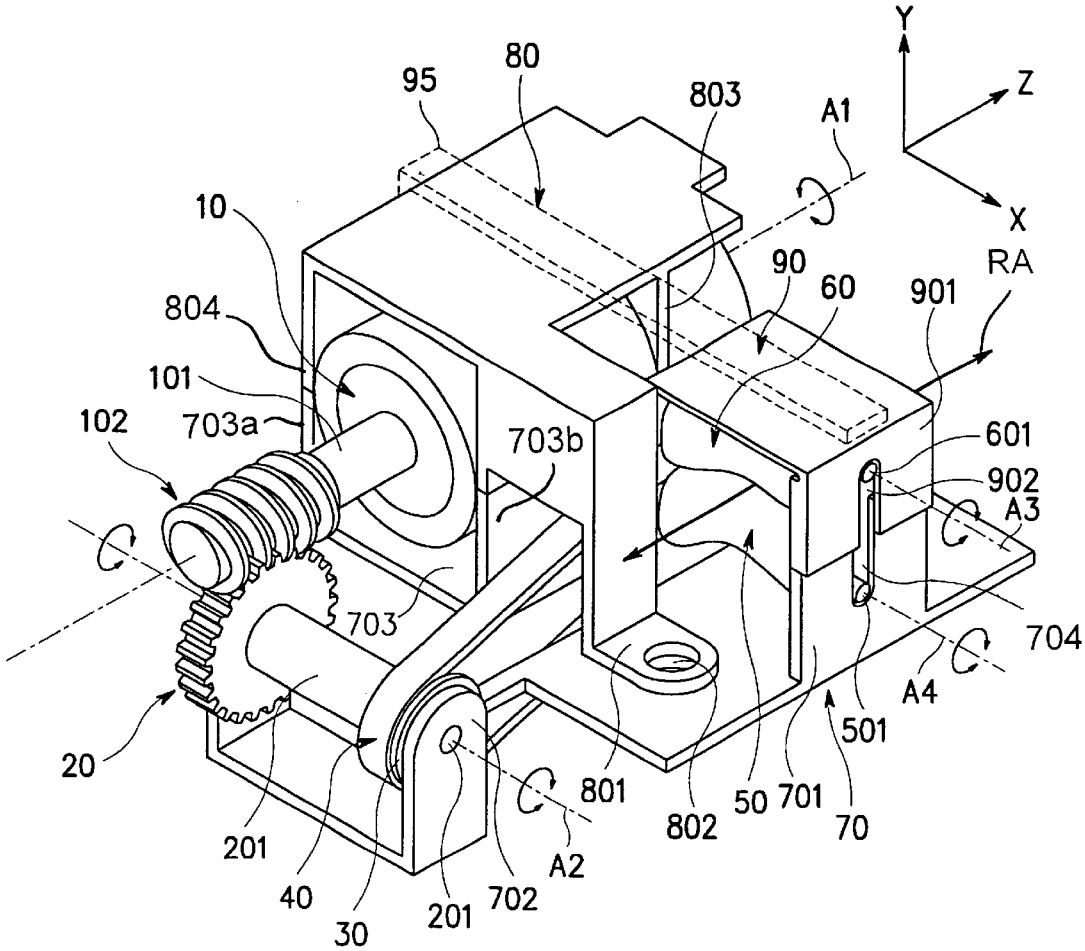
FIG. 8 is a perspective view of the automatic retractable antenna system according to the preferred embodiment of the present invention.

Referring to FIGS. 6, 7 and 8, the automatic retractable antenna system of the present invention is inserted into an antenna housing 1001*a*, and includes a driving motor 10 as a power source, a pair of rollers 50 and 60 for extending/retracting the rod antenna1001*b* a means for transferring a force from the driving motor to the rollers 50 and 60; and brackets 70, 80, and 90 for supporting the driving motor, the rollers 50 and 60, and the force transferring means. The force transferring means includes a worm 102, a worm gear (see FIG. 8), and a pulley arrangement including first and second rollers or wheels 30 and 35, and a timing belt 40. Timing belt 40 is preferably constructed of rubber. This force transferring means will be described in detail with reference to FIG. 9. In the automatic retractable antenna system, the rod antenna 1001*b* is retracted into the upper casing frame 1010 and lower casing frame 1020 in an on-hook state, and extended from the lower casing frame 1020 in an off-hook state.

Figure 9:
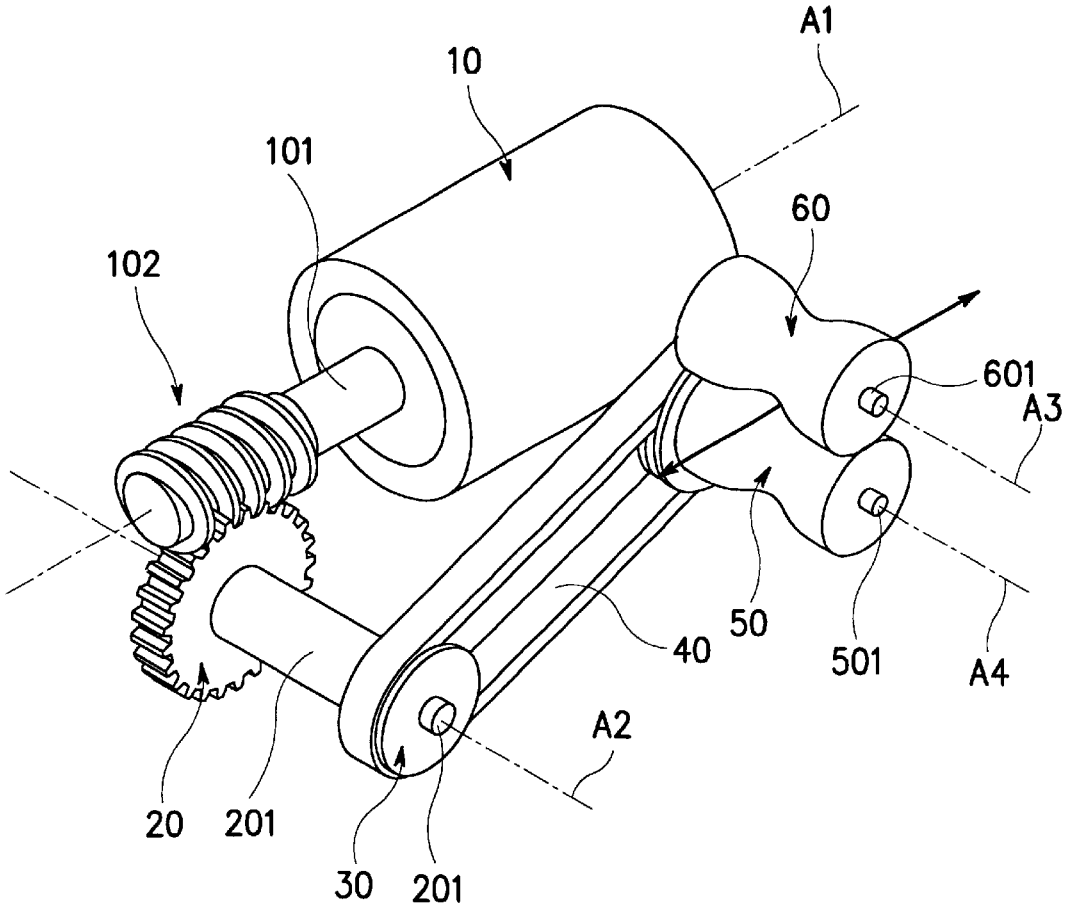
FIG. 9 is a detailed perspective of FIG. 8, the automatic retractable antenna system according to the preferred embodiment of the present invention, referred to for describing a force transfer.

FIG. 8 is a perspective view of the automatic retractable antenna system according to the preferred embodiment of the present invention, and FIG. 9 is a more detailed perspective view of the automatic retractable antenna system, referred to for describing a force transfer.

Referring to FIGS. 8 and 9, the force transferring means transfers the force of a driving motor 10 to the pair of rollers 50 and 60 in order to extend/retract the rod antenna. The force transferring means for transferring the force of the driving motor 10 to the pair of rollers 50 and 60 includes the worm 102, a worm gear 20, and a pulley arrangement including the first and second rollers or wheels 30 and 35 (see FIG. 7) for receiving the force of the worm gear 20, and the timing belt 40 for transferring the force of the roller or wheel 30 to the roller 35 or wheel.

In FIG. 8, an arrow X indicates a horizontal direction, an arrow Y indicates a vertical direction, and an arrow Z indicates a rotating axis direction of the driving motor 10. The driving motor 10, the worm gear 20, the first and second rollers or wheels 30 and 35, and the driving roller 50 are supported by first and second main brackets 70 and 80 in the automatic retractable antenna system. A driven roller 60 is installed to face the driving roller 50 in the sub-bracket 90.

The first main bracket 70 has a pair of upstanding walls 703*a* and 703*b* with a space 703 at the center thereof, elongated in the Z axis direction, for holding the driving motor 10. Bracket 70 also has a pair of upstanding free ends 701 facing each other to provide means for supporting the driving roller 50, and a pair of upstanding free ends 702, face each other, which provides means for supporting the worm gear 20 and the first roller or wheel 30.

The second bracket 80 has a pair of engaging ends 801, each having an engaging hole 802, to be engaged with the first bracket 70, and a guide rib 803 extending downward to support the driving motor 10 along with downwardly extending wall 804.

The driving motor 10 is the power source of the extending and retracting system and is fixed between main brackets 70 and 80 in the Z direction; a worm 102 is integrated onto the driving motor shaft 101. The worm 102 rotates in the A1 direction. A force is transferred from the worm 102 to the worm gear 20 and then to the first roller or wheel 30 of the pulley arrangement through roller shaft 201. Thus, the roller or wheel 30 rotates around a rotating axis A2. Subsequently, the force of the first roller or wheel 30 is transferred to the second roller or wheel 35 by the timing belt 40. Upon rotation of the second roller or wheel 35, the driving roller 50 and then driven roller 60 rotate. Therefore, the rod antenna is extended/retracted by rotating the pair of rollers 50 and 60.

Here, the driven roller 60 is retained within sub-bracket 90 and the driving roller 50 is retained by the free ends 701 of the first main bracket 70. The subbracket 90 is supported by cantilevered plate spring 95, which is fixed to main bracket 80, and free ends 901 of sub-bracket 90 are positioned over free ends 701 of bracket 70 in a telescopic fashion.

The sub-bracket 90 has a free end 901 on which a slot 902 is elongated in a vertical direction, for the retention of shaft 601 of driven roller 60. A slot 704 is elongated in a vertical direction on the free end 701 of the first main bracket 70, for the retention of shaft 501 of the driving roller 50 therein. The rod antenna is extended and retracted between rollers 50 and 60 and extended/retracted in a direction indicated by an arrow RA by the friction between the circumferential surface of the rod antenna and those of the rollers 50 and 60.

Preferably, rollers 50 and 60 are coated with rubber exhibiting an excellent frictional characteristic and are preferably shaped into an hour-glass to maximize the frictional area over the outer circumferential surface of the rod antenna. That is, the rollers 50 and 60 have a larger diameter at both of their ends than at their centers.

The slots, or vertically elongated holes 704 and 902 accommodate movement of the driving and driven rollers and thus the antenna when a disturbance is encountered during extending/retracting the rod antenna. Furthermore, since the typical rod antenna has a varying diameter throughout its length, a force is applied to the rollers 50 and 60 by sub-bracket 90 through cantilevered plate spring 95 to sustain contact with the rod antenna. During extending/retracting the rod antenna this forces maintains contact between rollers 50 and 60 and the rod antenna. The force has sufficient strength to sustain rollers 50 and 60 in contact with the rod antenna as the diameter varies throughout its length.

When a larger-diameter portion of the rod antenna passes between the rollers 50 and 60, the driven roller 60 moves slightly upward and when a smaller-diameter portion of the rod antenna passes between them, the driven roller 60 returns to its original position as a result of the compressive force of the cantilever plate spring 95 through sub-bracket 90 to driven roller 60. The rotating axis A1 of the driving motor 10 and worm 102 is at a right angle with respect to the rotating axis A2 of the worm gear 20, axis A4 of driving roller 50, and axis A3 of driven roller 60.

Referring to FIG. 9, when the driving motor 10 rotates clockwise or counterclockwise about axis Al, the worm 102 rotates on the same axis. Then, the worm gear 20 rotates in engagement with the worm 102. The worm gear 20 rotates about axis A2 the first roller 30 about axis A2 spaced from the worm gear 20 by the shaft 201. Then, a pulley arrangement comprising the first roller 30 transfers a force to the second roller 35 through the timing belt 40. Rotation of the second roller 35 leads to rotation of the driving roller 50 about axis A4, while the driven roller 60 rotates about axis A3 in contact with the driving roller 50. That is, the force of the driving motor 10 is transferred to the rollers 50 and 60, to thereby extend/retract the rod antenna.

Alternatively, the automatic retractable antenna system of the present invention can be operated manually. More specifically, since the rod antenna is extended/retracted by the friction between the rod antenna and the rollers 50 and 60 and the force of the driving motor 10 is transferred to the roller 50 and 60 through various paths, forced extension/retraction of the rod antenna will result in a slip between the rod antenna and the rollers 50 and 60 and between the first and second rollers or wheels 30 and 35 and the timing belt 40. Therefore, the rod antenna can be manually extended/retracted.

Especially, the slip between the pulley rollers 30 and 35 and the timing belt 40 is largest. With this slip, the disturbance produced to the automatic retractable antenna system can be coped with. That is, the transfer of the force from the driving motor 10 by the pulley rollers 30 and 35 and the timing belt 40 implies that the rod antenna can be extended/retracted manually or automatically.

In accordance with the present invention, the automatic retractable antenna system has a means for transferring the force of a driving motor to rollers, so that a rod antenna can be extended/retracted automatically or manually. Furthermore, the present invention can cope with disturbances produced during extending/retracting the rod antenna, external impacts on the phone or antenna itself, and the effects caused in part by the varying diameter of the rod antenna along its length, and vibrations generated during driving a driving motor. Advantageously, the automatic retractable antenna system can be fixed to a phone body at one assembly step.

While it is preferable to apply the automatic retractable antenna system of the present invention to a flip-type or folder-type terminal, the present invention is also applicable to other mobile communication terminals having an antenna device. In addition, the mechanism of transferring a force from the driving motor to the rollers for extending/retracting the rod antenna can include other force delivering elements in addition to the worm gear, the timing belt, and at least one roller.

While the present invention has been described in detail with reference to the specific embodiment, it is a mere exemplary application. Thus, it is to be clearly understood that many variations can be made by one skilled in the art within the scope and spirit of the present invention.

What is claimed is:

1. An extending and retracting mechanism for an antenna in a portable phone, comprising:

a driving motor producing a force;

a force transferring means receiving the force from the driving motor;

a pulley arrangement connected with the force transferring means having a first pulley roller and a timing belt for transferring the force from the first pulley roller to a second pulley roller;

a driving roller that receives the force from the second pulley roller;

a rod antenna disposed between the driving roller and a driven roller, wherein the rod antenna is extended/retracted by rotation of the driving roller and the driven roller;

a first main bracket for holding the driving motor, a first free end for supporting the force transferring means;

a second main bracket engaging the first main bracket; and a sub-bracket connected to the second main bracket, for supporting the driven roller and biasing the driven roller in a direction towards the driving roller.

2. The mechanism of claim 1, wherein the driving roller and the driven roller contact the rod antenna over a substantial portion of its length.

3. The mechanism of claim 1, wherein the driving roller and driven roller are rubber coated.

4. The mechanism of claim 1, wherein the driving roller and driven roller each have an hourglass shape.

5. The mechanism of claim 1, further comprising means to compensate the driving and the driven rollers for variations in diameter of the antenna.

6. The mechanism of claim 5, wherein the means for compensating include a telescoping arrangement between a part of the sub-bracket and the first main bracket, and wherein said sub-bracket is spring biased in a direction towards said first main bracket.

7. The mechanism of claim 6, wherein the means for compensating further comprises a vertical slot on said first main bracket in alignment with a vertical slot on said sub-bracket to accommodate a shaft of said driving roller and said driven roller, said rollers being in contact with the antenna.

8. The mechanism of claim 7, wherein the sub-bracket is biased towards the first main bracket by a plate spring.

9. The mechanism of claim 1, wherein the force transferring means includes a motor shaft, a worm attached to an end of said motor shaft, a worm gear engageable with said worm and a roller shaft which connects said worm gear to said first pulley roller.

10. An extending and retracting mechanism for an antenna in a portable phone, comprising:

a driving motor;

a force transferring means to provide power from the driving motor to a pulley arrangement including a driving roller and a driven roller; and means to maintain the driving roller and the driven roller in contact with a rod antenna, wherein the rod antenna is extended and retracted by rotation of the driving roller and the driven roller with the antenna.

11. The extending and retracting mechanism of claim 10, wherein the antenna has a varying diameter along its length.

12. The extending and retracting mechanism of claim 10, wherein the force transferring means is configured to slip to accommodate external disturbances interrupting the retraction or extension of the rod antenna.

13. The extending and retracting mechanism of claim 10, wherein the force transferring means is configured to slip to accommodate a manual extension and retraction of the rod antenna.

14. The extending and retracting mechanism of claim 10, wherein the pulley arrangement has a first pulley roller and a timing belt for transferring a force from the first pulley roller to a second pulley roller.

15. The extending and retracting mechanism of claim 14, wherein the driving roller receives the force from the second pulley roller.

* * * * *